United States Patent [19]

Overbury et al.

[11] 4,389,779

[45] Jun. 28, 1983

[54] RIBBED HANDLE AND GUARD CONSTRUCTION FOR CHAIN SAW

[75] Inventors: Douglas G. Overbury; Robert J. McDougall, both of Brockville, Canada

[73] Assignee: Black & Decker Inc., Newark, Del.

[21] Appl. No.: 251,721

[22] Filed: Nov. 18, 1980

[51] Int. Cl.[3] ..... B27B 17/02

[52] U.S. Cl. ..... 30/382; 30/383; 30/295; D8/65

[58] Field of Search ..... 30/340, 344, 381–387, 30/295; 310/50; D8/65

[56] References Cited

U.S. PATENT DOCUMENTS

| | | | |
|---|---|---|---|
| 2,931,674 | 4/1960 | Davies . | |
| 2,965,774 | 12/1960 | Rangus . | |
| 3,157,211 | 11/1964 | Wiig | 30/386 |
| 3,579,827 | 5/1971 | Grahn | 30/144 |
| 3,802,075 | 4/1974 | Taylor et al. | 30/216 |
| 3,857,179 | 12/1974 | Haupt et al. | 30/381 |
| 3,903,440 | 9/1975 | Paule et al. . | |
| 3,908,139 | 9/1975 | Duncan, Jr. . | |
| 3,911,304 | 10/1975 | Seely | 30/216 X |
| 3,967,698 | 7/1976 | Smith et al. | 30/382 X |
| 4,063,358 | 12/1977 | Hodge | 30/382 X |

*Primary Examiner*—Frank T. Yost

*Attorney, Agent, or Firm*—Harold Weinstein; Edward D. Murphy; Walter Ottesen

[57] ABSTRACT

A housing for a chain saw which is a clamshell type having a support section and a cover section. The cover section has a lower section which is at least three times wider than the width of the support section. The cover section has stiffening ribs formed on the underside of the wide lower section. Fastening means enterconnect the support section and the cover section.

8 Claims, 8 Drawing Figures

FIG. 5
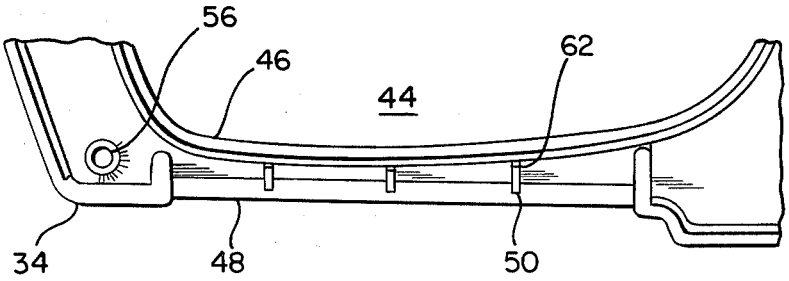
FIG. 6
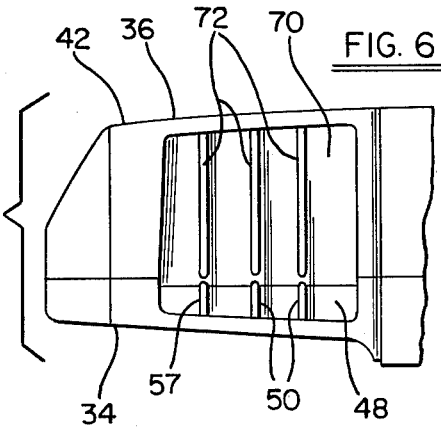
FIG. 7
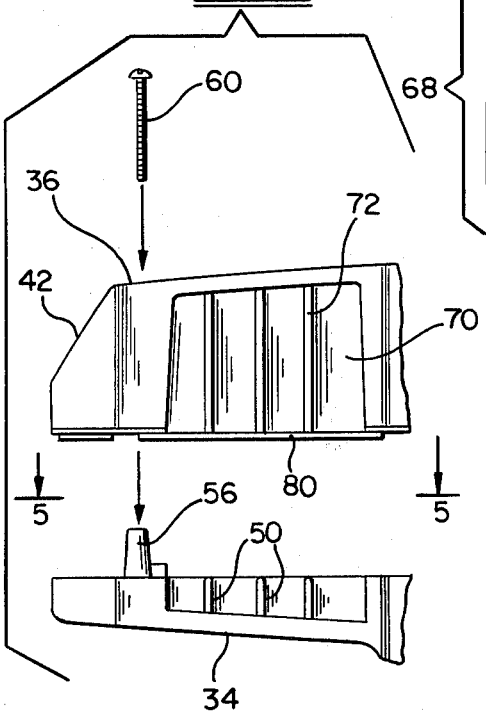
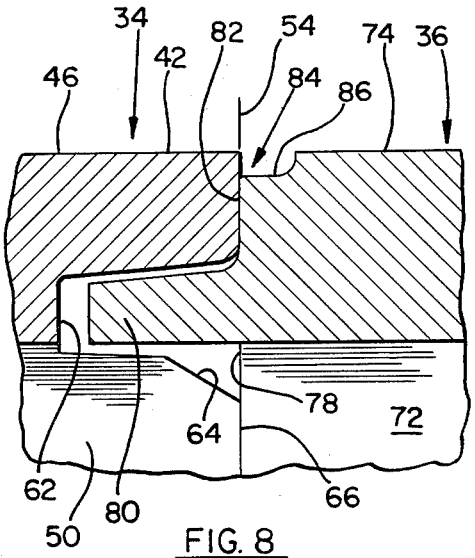
FIG. 8

RIBBED HANDLE AND GUARD CONSTRUCTION FOR CHAIN SAW

BACKGROUND OF THE INVENTION

Heretofore prior art clamshell housings were made of equally-sized halves. At the seam line a raised recess on one half received a peripheral rim of the other half. Enlarging the width required substantially increased thickness and a double housing on both the top and bottom surfaces. This resulted in housings with limited configurations, enlarged size and expensive houses using more material.

SUMMARY OF THE INVENTION

It is an object of the present invention to provide an improved ribbed handle and guard construction for a chain saw which overcomes the piror art disadvantages; which is simple, reliable and economical; which is included in a clamshell housing; which is included in a clamshell handle; which is a two-part handle, one narrow and the other wide and the wide part having stiffening ribs; which wide part has a smooth surface and a ribbed surface; which uses a shadow line adjacent the parting line; which has a handle portion with a wide part three times greater than the narrow portion; and which provides a wide base for placing the chain saw on a flat surface or the ground.

Other objects and advantages will be apparent from the following description of the invention, and the novel features will be particularly pointed out hereinafter in the claims.

BRIEF DESCRIPTION OF THE DRAWINGS

This invention is illustrated in the accompanying drawings in which:

FIG. 5 is an elevational view taken along line 5—5 of FIG. 7.

FIG. 6 is a partial bottom plan view of the handle of the housing embodying the present invention.

FIG. 7 is an exploded view of FIG. 6.

FIG. 8 is an enlarged view of the parting line shown in FIG. 3.

DESCRIPTION OF THE INVENTION

Figure 1:
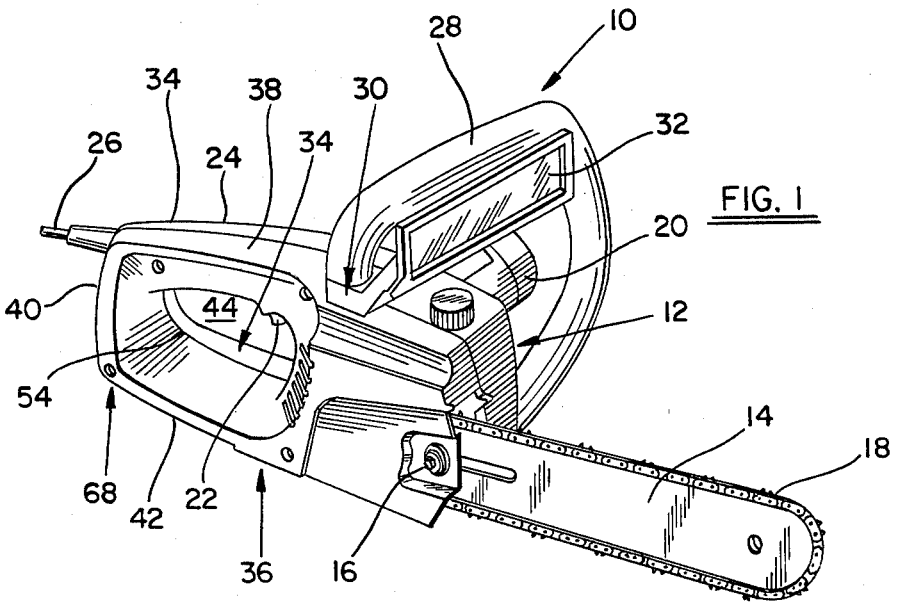
FIG. 1 is a perspective view of a chain saw embodying the present invention.

A portable power driven chain saw 10 is shown in FIG. 1 and and embodies the present invention. The chain saw 10 has a housing 12 from which a guide bar 14 extends forwardly therefrom and is connected thereto by a fastener 16. An endless saw chain 18 is entrained on the guide bar 14 to be driven by a suitable motive means as, for example, an electric motor (not shown) housed in a motor casing 20. The motor is energized by a trigger switch 22 mounted in a rear hande 24 and connected to a source of electricity by an electric cord 26.

The housing 12 shown in FIG. 1 has a forward auxiliary handle 28 which connects to the housing 12 at 30 and is disposed transversely across and wraps around and forwardly of the motor casing 20. The chain saw 10 may be conveniently and easily controlled during operation by the operator grasping the rear handle 24 and the forward handle 28. An upper handguard 32 is also connected to the housing at 30.

Figure 2:
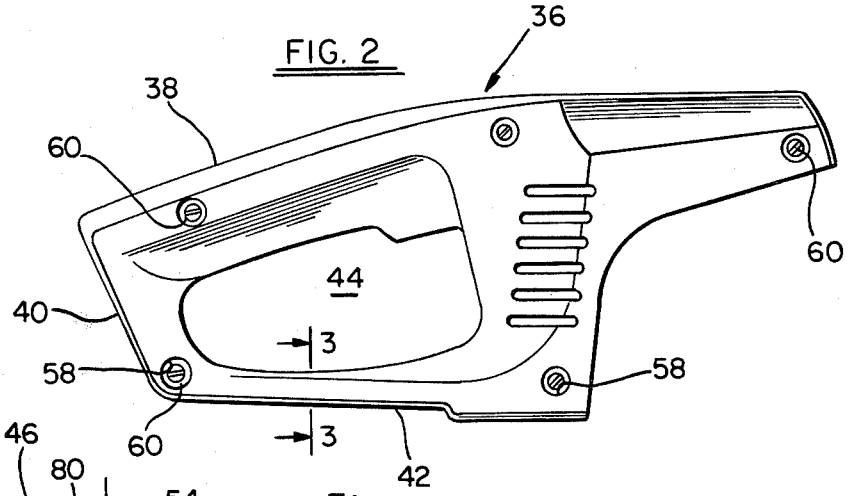
FIG. 2 is a side elevational view of the cover shown in FIG. 1.

The housing 12 illustrated in FIG. 1 is a clamshell type with a support section 34 and a cover section 36 shown in FIGS. 1 and 2. The handle 24 is narrow at its upper section 38 and has an enclosed rear section 40 from where it bends forwardly to form an enwidened lower section 42. An opening 44 is formed interiorly of the handle 24 and provides access to the trigger switch 22 extending therein.

Figure 3:
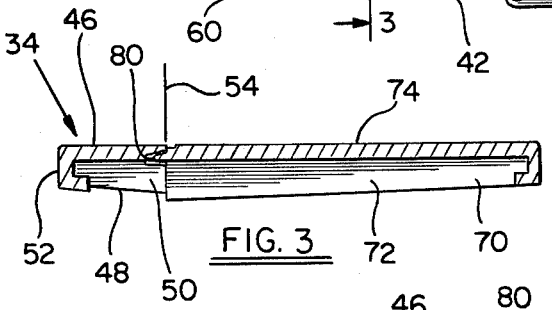
FIG. 3 is an elevational view, partly in section, taken along line 3—3 of FIG. 2.
Figure 4:
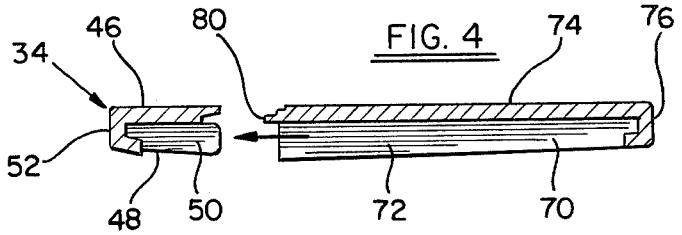
FIG. 4 is an exploded view of FIG. 3.

The support section 34 at least in the area of the handle 24 is of a substantially constant width which is shown in FIGS. 3 and 4 as being relatively narrow. The support section 34 has a smooth continuous surface 46 over its exterior, except for the bottom 48 wherein a plurality of transverse interlock ribs 50 shown in FIGS. 3, 6 and 7 extend from underneath the surface 46 of the lower section 42 from a side surface 52 to terminate at a parting line 54.

Adjacent the ribs 50 a boss 56 is shown in FIGS. 5 and 7 which is typical of the connection members formed in the support section 34 which extend into the deep well openings of the cover section 36 in alignment with openings 58 shown in FIGS. 1 and 2 for receiving fasteners 60 which may be self-tapped into the boss 56, only one of which is shown. The support section 34 also has a recess 62 shown best in FIG. 8 extending peripherally inwardly at the parting line 54 intermediate the underside of the surface 46 and the upper end of the ribs 50, with the rib 50 being beveled at 64 at its upper outer end 66.

The cover section 36 at its lower section 42 is wider than the upper section 38 thereof with the upper section being of substantially equal width to that of the support section 34. The cover section 36 shown in FIG. 1 increases in width along a straight slope from the top to the enwidened bottom so that the width of the lower section 42 of the cover section 36 is at least three times wider than that of the support section 34 as shown in FIGS. 3 and 6, which in the preferred embodiment is up to 2.5 inches wide. The lower section 42 forms a lower handguard 68 shown best in FIG. 1 so as to protect the operator's hand which grasps the handle 24 especially in the event of saw chain 18 breakage or degrooving thereof. The cover section 36 has an uncovered bottom 70 with transverse stiffening ribs 72 extending from under a smooth continuous surface 74 which turns down at its sides 76 to terminate at an outer end 78 at the parting line 54 as shown in FIGS. 3, 4 and 8. A peripheral rim 80 extends the length of the ribbed bottom 70 as shown in FIGS. 8 and 7, respectively. The rim 80 extends in noncontacting relationship into the recess 62. The rim 80 aids in assembly and under stress, can assist in distributing and transferring torque.

Subsequent to connecting the chain saw 10 to the support section 34 of the housing 12, the cover section 36 will be connected by the fasteners 60 thereto to form a mating line at the parting line 54 wherein the ends 66 and 78 of the respective ribs 50 and 72 abut and the end of surface 46 of support section 34 abuts a shoulder 82 of the cover section 36 at the parting line 54 as best seen in FIG. 8. A shadow line 84 is formed by a recess 86 extending at the parting line 54 at the corner of the shoulder 82 and the upper surface 74.

The wide lower section 42 also makes it convenient to set the chain saw 10 at rest upon the ground or other suitable support surface, right side up.

The stiffening ribs 72 of the bottom 70 eliminate a bottom enclosure or continuous surface which otherwise would be required and would be a problem to core out in a section so wide as that of the lower section 42 of the cover section 36.

It will be understood that various changes in the details, materials, arrangements of parts and operating conditions which have been herein described and illustrated in order to explain the nature of the invention may be made by those skilled in the art within the principles and scope of the invention.

Having thus set forth the nature of the invention what is claimed herein is:

1. A clamshell housing for a power tool comprising:
(a) a support member having the power tool affixed thereto,
(b) an open section of predetermined width formed on the support member,
(c) a cover member detachably connected to enclose the open section of the support member, and to define a parting line therebetween,
(d) the cover member having a width at least three times greater than the width of the open section,
(e) the cover having a continuous smooth surface on one side thereof,
(f) a plurality of stiffening ribs extending from the underneath side of said surface transversely across the width thereof to support and stiffen the cover, and
(g) fastening means connecting the cover to the open section of the support member.

2. The combination claimed in claim 1 wherein:
(a) the open section having a continuous smooth surface which mates with said surface of the cover,
(b) a parting line recess formed in the open section below the surface, and
(c) a parting line rim formed on the cover extending from below the surface, and the rim disposed in the recess.

3. The combination claimed in claim 2 wherein:
(a) a plurality of interlock ribs transversely formed underneath the surface of the open section, and
(b) the interlock ribs abut the stiffening ribs at the parting line.

4. The combination claimed in claim 3 wherein:
(a) a shoulder extending along the periphery above the rim,
(b) the shoulder formed continuous with and at the mating line of the surface, and
(c) the shoulder abutting the edge of the surface above the recess therein.

5. The combination claimed in claim 4 wherein:
(a) the rim extends into the recess normally in non-contacting relationship therein and under stress to be engaged and to support the interconnection between the open section and the cover.

6. A housing for a portable power tool comprising:
(a) a handle formed at one end of the power tool,
(b) the handle having a narrow top upper portion wrapping around to an enlarged widened lower portion.
(c) the handle connected to the housing at the upper and lower portions thereof,
(d) the handle is clamshell with a support section and a cover section,
(e) the support section having a narrow width of predetermined dimension,
(f) the cover section having a narrow width at the upper portion and an enlarged lower portion several times wider than the lower portion width of the support section.
(g) stiffening ribs formed on the lower portion of the cover section, and
(h) fastening means connecting the cover section to the support section.

7. The combination claimed in claim 6 wherein:
(a) the lower portion of the cover section having a width at least three times greater than the width of the lower portion of the support section.

8. The combination claimed in claim 7 wherein:
(a) the ribs formed on the underside of the lower portion of the cover section, and
(b) an upper surface formed on the lower portion of the cover section to lie smooth and continuous with the corresponding surface of the lower portion of the support section.

* * * * *